US010249459B2

(12) United States Patent
Yang et al.

(10) Patent No.: US 10,249,459 B2
(45) Date of Patent: Apr. 2, 2019

(54) ADVANCED COOLING SYSTEM FOR ELECTRICAL EQUIPMENT

(71) Applicant: EATON INTELLIGENT POWER LIMITED, Dublin (IE)

(72) Inventors: He Yang, Shanghai (CN); Li Yu, Pittsburgh, PA (US); Jiong Chen, Shanghai (CN); Mark Mao, Shanghai (CN); Chao Xin, Shanghai (CN); Yujie Yang, Hangzhou (CN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/268,716

(22) Filed: Sep. 19, 2016

(65) Prior Publication Data

US 2018/0082812 A1 Mar. 22, 2018

(51) Int. Cl.

| | |
|---|---|
| ***H01H 33/66*** | (2006.01) |
| ***H01H 9/52*** | (2006.01) |
| ***H01H 11/00*** | (2006.01) |
| ***H01F 38/14*** | (2006.01) |

(52) U.S. Cl.

CPC ..... *H01H 33/66* (2013.01); *H01F 38/14* (2013.01); *H01H 9/52* (2013.01); *H01H 33/6606* (2013.01); *H01H 2011/0068* (2013.01); *H01H 2033/6613* (2013.01)

(58) Field of Classification Search

CPC ..... H01H 33/66; H01H 33/6606; H01H 9/54; H01H 71/10; H01F 38/14; H02B 13/00; H02B 11/28

USPC ..... 218/139, 134, 155, 118; 200/144 B

See application file for complete search history.

(56) References Cited

U.S. PATENT DOCUMENTS

| | | | | |
|---|---|---|---|---|
| 3,973,096 | A * | 8/1976 | Burgoon | H01H 9/52 200/289 |
| 4,005,297 | A * | 1/1977 | Cleaveland | F28D 15/02 165/104.26 |
| 4,650,939 | A * | 3/1987 | Milianowicz | H01H 1/62 200/289 |
| 5,753,875 | A * | 5/1998 | Benke | H01H 9/52 218/118 |
| 7,031,155 | B2 * | 4/2006 | Sauciuc | F04D 33/00 361/695 |
| 8,278,582 | B2 * | 10/2012 | Tu | H01H 9/52 218/118 |

(Continued)

FOREIGN PATENT DOCUMENTS

EP 2 874 170 A1 5/2015

OTHER PUBLICATIONS

European Patent Office, "International Search Report and Written Opinion" PCT/US17/051278, dated Sep. 13, 2017, 10 pp.

*Primary Examiner* — Edwin A. Leon
*Assistant Examiner* — William A Bolton
(74) *Attorney, Agent, or Firm* — Eckert Seamans

(57) ABSTRACT

A cooling system for a circuit breaker is provided. The cooling system includes a temperature management unit, a power assembly, and a heat dissipating assembly. The temperature management unit is structured to detect the temperature at one of the circuit breaker or the conductor assembly. The power assembly is structured to harvest energy from the circuit breaker. The heat dissipating assembly includes a number of convection units, each heat convection unit is disposed immediately adjacent a number of the heat exchanging element.

20 Claims, 2 Drawing Sheets

(56) References Cited

U.S. PATENT DOCUMENTS

| | | | | |
|---|---|---|---|---|
| 8,913,370 | B2 * | 12/2014 | Smith | H05K 5/0217 361/620 |
| 9,215,825 | B2 * | 12/2015 | Sano | H01H 9/08 |
| 2008/0115924 | A1 | 5/2008 | Kiefer et al. | |
| 2012/0199322 | A1 | 8/2012 | Frigiere et al. | |
| 2015/0047372 | A1 | 2/2015 | Kaufmann et al. | |
| 2015/0139275 | A1 * | 5/2015 | Park | G01K 13/00 374/152 |
| 2015/0357136 | A1 * | 12/2015 | Chen | H01H 33/664 218/123 |

* cited by examiner

ADVANCED COOLING SYSTEM FOR ELECTRICAL EQUIPMENT

BACKGROUND OF THE INVENTION

Field of the Invention

The disclosed and claimed concept relates to electrical equipment and, more specifically, to electrical equipment including a cooling system utilizing convection units such as, but not limited to, piezoelectric fans.

Background Information

Electrical equipment having current flowing therethrough generate heat. For example, circuit breakers, and other such devices, provide protection for electrical systems from electrical fault conditions such as current overloads, short circuits, and low level voltage conditions. In one embodiment, circuit breakers include a spring-powered operating mechanism which opens electrical contacts to interrupt the current through the conductors in an electrical system in response to abnormal conditions. In particular, vacuum circuit interrupters include separable main contacts disposed within an insulated and hermetically sealed vacuum chamber within a housing.

The contacts are part of an electrode including a stem and a contact member. Generally, one of the electrodes is fixed relative to the housing. The other electrode is moveable relative to the housing and the other electrode. An operating mechanism is structured to move the movable contact between a first configuration, wherein the movable contact is spaced from, and is not in electrical communication with, the fixed contact and a second configuration, wherein the movable contact is directly coupled to, and is in electrical communication with, the fixed contact. In this configuration, a vacuum interrupter is structured to interrupt medium voltage alternating current (AC) and, also, high voltage AC currents of several thousands of amperes or more. In one embodiment, one vacuum interrupter is provided for each phase of a multi-phase circuit and the vacuum interrupters for the several phases are actuated simultaneously by a common operating mechanism, or separately or independently by separate operating mechanisms. The electrodes can commonly take three positions: closed, opened and grounded.

The electrodes are also part of a larger conductor assembly that includes a first terminal, a first primary conductor, a second primary conductor and a second terminal. The first terminal is structured to be coupled to, and in electrical communication with, either a line or a load. The first terminal is coupled to, and in electrical communication with, the first primary conductor. The first primary conductor is coupled to, and in electrical communication with, the fixed electrode. The second terminal is structured to be coupled to, and in electrical communication with, the other of either a line or a load. The second terminal is coupled to, and in electrical communication with, the second primary conductor. The second primary conductor is coupled to, and in electrical communication with, the movable electrode.

The first and second primary conductors are generally made from either generally cylindrical copper members or a number of generally planar copper members. In some instances planar copper members are bent. Further, in some instances, multiple planar copper members are disposed in a stack. Such conductors, and circuit breakers including such conductors, have several disadvantages.

Such primary conductors generate heat as current passes therethrough. Generally, a housing assembly in which the circuit breaker is disposed includes a fan that vents air from the housing assembly. Further, the primary conductors may be thermally coupled to a heat sink. The housing assembly fans run, generally, continuously. The disadvantage, or stated problems, of such a configuration is that moving air is not specifically directed over the primary conductors or the heat sink. As such, the cooling system is not efficient as a cooling system that directs moving air over the primary conductors or the heat sink. Further, such fans are powered by a line that taps into the conductor assembly of the circuit breaker. Such cooling systems require more than a minimal current. Thus, the cooling system diminishes the current in the load conductor. Further, elements of the power tap are relatively expensive and require time to install. Further, the fans are not temperature controls and operate whether needed or not. This operation drains energy needlessly and creates a generally constant noise.

There is, therefore, a need for a cooling system that is not subject to the disadvantages identified above. Further, there is a need for a cooling system that is usable in existing circuit breakers.

SUMMARY OF THE INVENTION

These needs, and others, are met by a number of embodiments of the disclosed and claimed concept which provides a cooling system for electrical equipment, such as, but not limited to, a circuit breaker, the cooling system including a temperature management unit, a power assembly, and a heat dissipating assembly. The temperature management unit is structured to detect the temperature at one of the circuit breaker or the conductor assembly. The power assembly is structured to harvest energy from the circuit breaker. The heat dissipating assembly includes a number of convection units, each of the heat convection units disposed immediately adjacent a number of the heat exchanging elements.

Another embodiment provides a circuit breaker including a conductor assembly, a number of heat exchanging elements, and a cooling system. The cooling system includes a temperature management unit, a power assembly, and a heat dissipating assembly. The conductor assembly is thermally coupled to a number of the heat exchanging elements, and the heat dissipating assembly. The temperature management unit is structured to detect the temperature at one of the circuit breaker or the conductor assembly. The power assembly is structured to harvest energy from the circuit breaker. The heat dissipating assembly includes a number of convection units, each of the heat convection units disposed immediately adjacent a number of the heat exchanging elements.

In this configuration, the cooling system solves the problems stated above.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
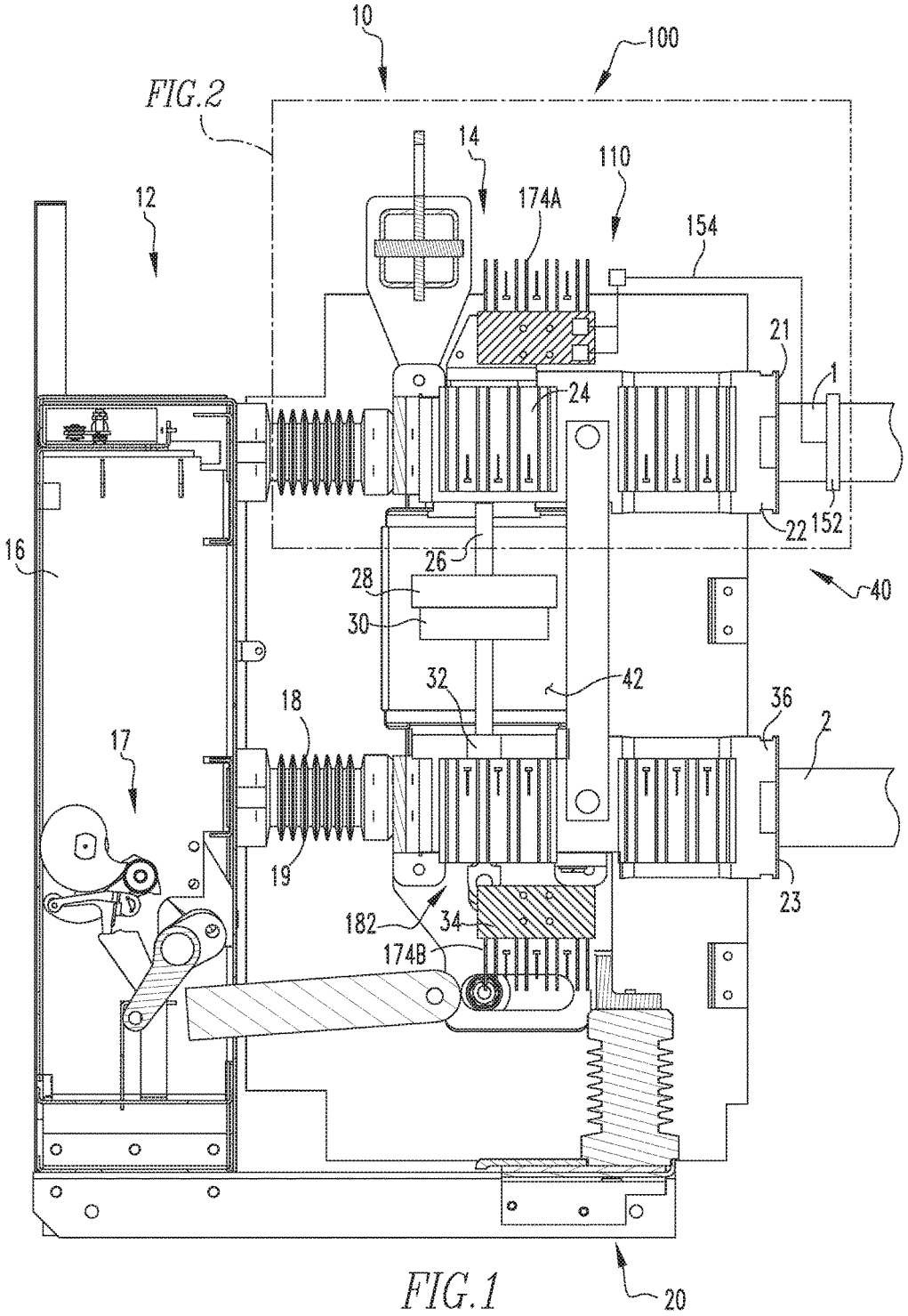
FIG. 1 is a side view of a vacuum circuit breaker.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, the phrase "removably coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. Further, as used herein, "loosely correspond" means that a slot or opening is sized to be larger than an element disposed therein. This means that the increased size of the slot or opening is intentional and is more than a manufacturing tolerance. With regard to surfaces, shapes, and lines, two, or more, "corresponding" surfaces, shapes, or lines have generally the same size, shape, and contours.

As used herein, a "path of travel" or "path," when used in association with an element that moves, includes the space an element moves through when in motion. As such, any element that moves inherently has a "path of travel" or "path." When used in association with an electrical current, a "path" includes the elements through which the current travels.

As used herein, the statement that two or more parts or components "engage" one another shall mean that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate. Further, with electronic components, "operatively engage" means that one component controls another component by a control signal or current.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality).

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately," i.e., in an approximate range relevant to the measurement as would be understood by one of ordinary skill in the art.

As used herein, "in electronic communication" is used in reference to communicating a signal via an electromagnetic wave or signal. "In electronic communication" includes both hardline and wireless forms of communication; thus, for example, a "data transfer" or "communication method" via a component "in electronic communication" with another component means that data is transferred from one computer to another computer (or from one processing assembly to another processing assembly) by physical connections such as USB, Ethernet connections or remotely such as NFC, blue tooth etc. and should not be limited to any specific device.

As used herein, a "computer" is a device structured to process data having at least one input device, e.g., a keyboard, mouse, or touch-screen, at least one output device, e.g., a display, a graphics card, a communication device, e.g., an Ethernet card or wireless communication device, permanent memory, e.g., a hard drive, temporary memory, i.e., random access memory, and a processor, e.g., a programmable logic circuit. The "computer" may be a traditional desktop unit but also includes cellular telephones, tablet computers, laptop computers, as well as other devices, such as gaming devices that have been adapted to include components such as, but not limited to, those identified above. Further, the "computer" may include components that are physically in different locations. For example, a desktop unit may utilize a remote hard drive for storage. Such physically separate elements are, as used herein, a "computer."

As used herein, the word "display" means a device structured to present a visible image. Further, as used herein, "present" means to create an image on a display which may be seen by a user.

As used herein, a "computer readable medium" includes, but is not limited to, hard drives, CDs, DVDs, magnetic tape, floppy drives, and random access memory.

As used herein, "permanent memory" means a computer readable storage medium and, more specifically, a computer readable storage medium structured to record information in a non-transitory manner. Thus, "permanent memory" is limited to non-transitory tangible media.

As used herein, "stored in the permanent memory" means that a module of executable code, or other data, has become functionally and structurally integrated into the storage medium.

As used herein, a "file" is an electronic storage construct for containing executable code that is processed, or, data that may be expressed as text, images, audio, video or any combination thereof.

As used herein, a "module" is an electronic construct used by a computer, or other processing assembly, and includes, but is not limited to, a computer file or a group of interacting computer files such as an executable code file and data storage files, used by a processor and stored on a computer readable medium. Modules may also include a number of other modules. It is understood that modules may be identified by their purpose of function. Unless noted otherwise, each "module" is stored in permanent memory of at least one computer or processing assembly. All modules are shown schematically in the Figures.

As used herein, "generally" means "in a general manner" relevant to the term being modified as would be understood by one of ordinary skill in the art.

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, when elements are in "electrical communication" a current may flow between the elements. That is, when a current is present and elements are in "electrical communication," then the current flows between the elements. It is understood that elements that are in "electrical communication" have a number of conductive elements, or other constructs, disposed therebetween creating the path for the current.

As used herein, a "planar body" or "planar member" is a generally thin element including opposed, wide, generally parallel surfaces, i.e., the planar surfaces of the planar member, as well as a thinner edge surface extending between the wide parallel surfaces. That is, as used herein, it is inherent that a "planar" element has two opposed planar surfaces. The perimeter, and therefore the edge surface, may include generally straight portions, e.g., as on a rectangular planar member, or be curved, as on a disk, or have any other shape.

Referring to FIG. 1, there is illustrated electrical equipment 8, shown as a vacuum circuit breaker 10 incorporating a vacuum interrupter assembly 40. It is understood that the vacuum circuit breaker 10 is exemplary only and that the electrical equipment 8, includes vacuum switchgear as well as medium voltage and high voltage switchgear, such as SF6, oil switchgear, MV or HV transformers, and busbar electrical equipment (none shown). Further, such systems are not limited to AC systems, but includes DC systems as well. As is known, the vacuum circuit breaker 10 may be a single pole or multi-pole vacuum circuit breaker 10. Hereinafter, and as an exemplary embodiment, only a single pole will be discussed. It is, however, understood that the claims are not limited to an embodiment having only a single pole. Generally, the vacuum circuit breaker 10, in an exemplary embodiment, includes a low voltage portion 12 and a high voltage portion 14. The low voltage portion 12 includes a housing 16 structured to include a control device (not shown) such as, but not limited to, a circuit breaker assembly and/or a control panel for manually operating the vacuum circuit breaker as well as an operating mechanism 17, shown schematically. The operating mechanism 17 is structured to change the state of the contacts 28, 30 (discussed below) to either an open or closed configuration. The control device is structured to actuate the operating mechanism 17. The low voltage portion 12 is coupled to the high voltage portion 14 via stand-off supports 18 which, in an exemplary embodiment, are insulated rods 19.

Generally, a line conductor 1 is coupled to, and is in electrical communication with, the upper, first terminal 22 (discussed below) and a load conductor 2 is coupled to, and is in electrical communication with, the lower, second terminal 36 (discussed below). There are instances, however, such as when a line enters through a floor (not shown), wherein the line is coupled to, and is in electrical communication with, the lower, second terminal 36. Thus, it is understood that the location of the line/load depends upon the configuration of each vacuum circuit breaker 10. In the example shown, it is assumed that the line is coupled to, and is in electrical communication with, the upper, first terminal 22 and the load is coupled to, and is in electrical communication with, the lower, second terminal 36. As used herein, the line conductor 1 and the load conductor 2 are considered to be part of the vacuum circuit breaker 10.

The high voltage portion 14 includes a conductor assembly 20 as well as other elements. Each pole of the conductor assembly 20 includes a line, first terminal 22, a first primary conductor 24, a first stem assembly 26, a first contact 28, a second contact 30, a second stem assembly 32, a second primary conductor 34 and a load, second terminal 36. The first stem assembly 26, first contact 28, second contact 30, and second stem assembly 32, as well as a vacuum housing 42, are also collectively identified as the vacuum interrupter assembly 40. That is, the first contact 28 and the second contact 30, as well as portions of the first stem assembly 26 and the second stem assembly 32, are disposed within a vacuum housing 42. Further, one or both of the first contact 28 and the second contact 30 are operatively coupled to the operating mechanism 17. The operating mechanism 17 is structured to move the first contact 28 and the second contact 30 between a first configuration, wherein the first contact 28 is spaced from, and is not in electrical communication with, the second contact 30 and a second configuration, wherein the first contact 28 is directly coupled to, and is in electrical communication with, the second contact 30.

The first terminal 22 is structured to be, and is, coupled to a line 1 (FIG. 1) and includes a fixed coupling 21. The second terminal 36 is structured to be, and is, coupled to a load 2 (FIG. 1) and includes a fixed coupling 23. In an exemplary embodiment, the first terminal coupling 21 and the second terminal coupling 23 are in a "fixed" location. That is, as used herein in reference to electrical terminal couplings 21, 23, "fixed" means that during operation of the vacuum circuit breaker 10, the conductive couplings 21, 23 of the terminals 22, 36 do not move relative to other elements of the vacuum circuit breaker 10. Further, as is known, the first and second terminals 22, 36 include, in an exemplary embodiment, a coupling device such as, but not limited to, opposed sets of flexible "fingers" (not shown). The opposed sets of flexible fingers are also known as "finger clusters."

In an exemplary embodiment, the vacuum circuit breaker 10 includes a "directed cooling system" 100 or, hereinafter, "cooling system" 100. As used herein, a "system" is a collection of constructs that are structured to operate collectively. That is, for example, a fan and a heat sink, wherein the fan that directs moving air over a heat sink, operate collectively and are a single "cooling system" rather than two separate cooling systems. Further, constructs that, while possibly influencing each other, are not structured to operate collectively are not a "system." For example, a fan located near a heat sink wherein the moving air is not directed over the heat sink is not a "cooling system" but rather two separate cooling constructs. It is understood that a fan directs, i.e., pushes or pulls, a substantially laminar fluid flow for a limited distance away from the fan; beyond the limited distance, the fluid flow becomes turbulent. As used herein, a fluid flow is "directed" during the substantially laminar portion of the flow. It is understood that the "directed" fluid flow away from a fan becomes turbulent upon impinging an object, such as a heat sink. Conversely, fluid drawn into the fan is only substantially laminar for a limited distance before entering the fan. As used herein, an object within the path of a substantially laminar fluid flow that causes the substantially laminar fluid flow to become turbulent is within the "directed" fluid flow. However, an object downstream, or otherwise spaced, from an object within the path of a substantially laminar fluid flow that causes the substantially laminar fluid flow to become turbulent, i.e., an object in the turbulent flow but which does not cause the turbulent flow, is not in the "directed" fluid flow. For example, a housing assembly fan that is spaced from another element does not include that element in its substantially laminar fluid flow. That is, as used herein, a housing assembly fan does not generate a "directed" fluid flow. Thus, as used herein, a "directed cooling system" includes more than one element that cooperatively cools other elements and which include an element (or assembly) that generates fluid flow and wherein that fluid flow is laminar over, or up to, other elements of the system.

Figure 2:
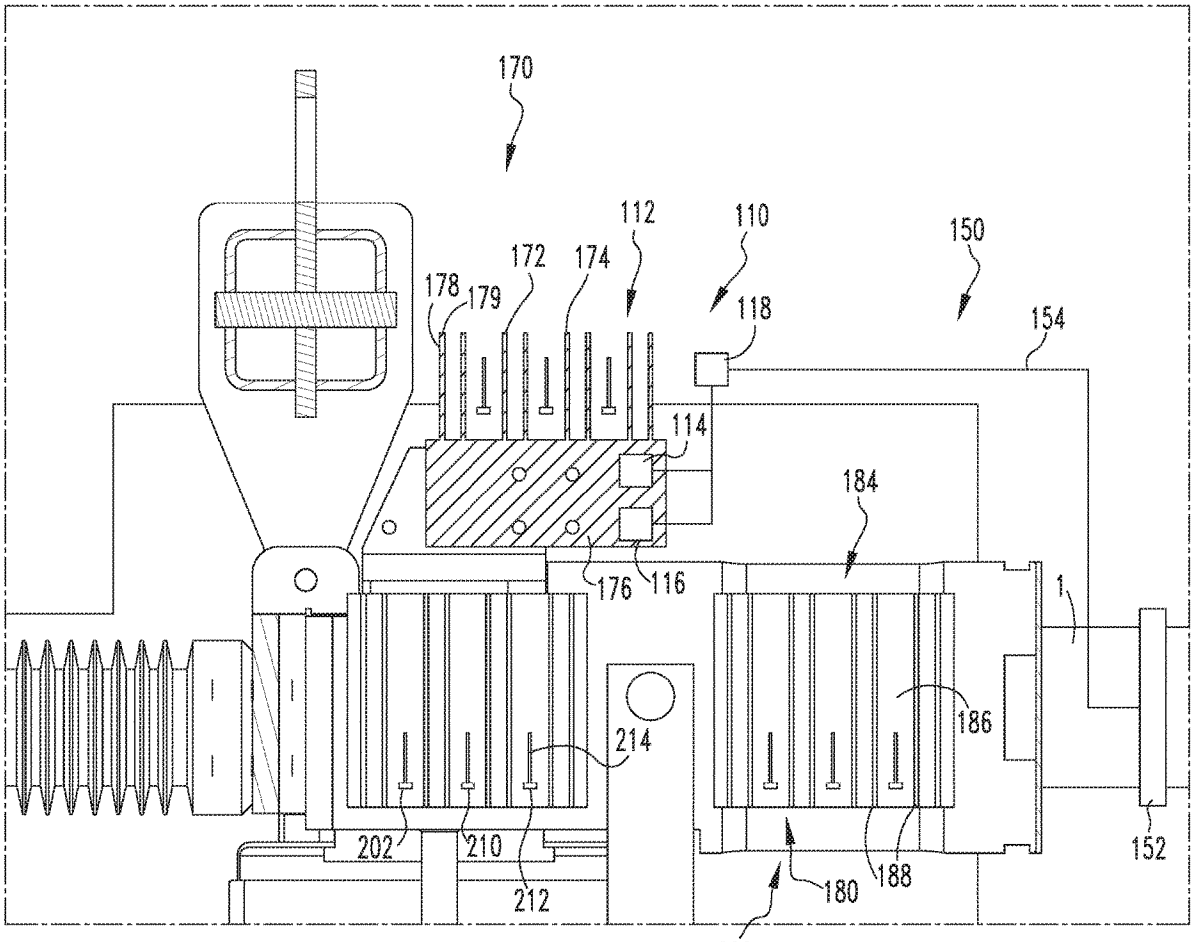
FIG. 2 is a detail view of a portion of a vacuum circuit breaker conductor assembly with a directed cooling system.

In an exemplary embodiment, as shown in FIG. 2, the cooling system 100 includes a temperature management unit 110, a power assembly 150, a number of heat exchanging elements 170, and a heat dissipating assembly 200. The temperature management unit 110 includes a programmable logic circuit assembly 118 (hereinafter "PLC assembly" 118) including a processor, wireless input/output assemblies, and memory (none shown). That is, as used herein, the PLC assembly 118 is a "computer" as defined above but does not include a display, graphics card, or an attached input device. The PLC assembly 118 is structured to communicate with the number of sensors 112, discussed below, to store data from the number of sensors 112, and to actuate the heat dissipating assembly 200. That is, as is known, the PLC assembly 118 includes a number of modules (not shown) structured to communicate with the number of sensors 112, to store data from the number of sensors 112, and to actuate the heat dissipating assembly 200.

In an exemplary embodiment, the temperature management unit 110 is structured to detect the temperature at one of the vacuum circuit breaker 10 and/or the conductor assembly 20. The temperature management unit 110 is also structured to detect the ambient temperature near the vacuum circuit breaker 10. As is known, the temperature management unit 110 includes a number of sensors 112. In an exemplary embodiment, the number of sensors 112 includes both a number of temperature sensors 114 and a number of current sensors 116 (both shown schematically). The temperature sensors 114 are coupled, directly coupled, or fixed to the vacuum circuit breaker 10 and/or the conductor assembly 20. The current sensors 116 are coupled, directly coupled, or fixed to the conductor assembly 20 and structured to detect a number of current characteristics of the current in the conductor assembly 20. The number of sensors 112 are in electronic communication with the PLC assembly 118.

The temperature management unit 110 is further structured to actuate a selected number of convection units 202 (which are part of the heat dissipating assembly 200) when a first temperature is detected at said vacuum circuit breaker 10 and/or said conductor assembly 20. The temperature management unit 110 is further structured to de-actuate the selected number of convection units 202 when a second temperature is detected at said vacuum circuit breaker 10 and/or said conductor assembly 20. The second temperature is lower than the first temperature. That is, colloquially, the temperature management unit 110 is structured to turn on piezoelectric fans 210, discussed below, when the vacuum circuit breaker 10 and/or said conductor assembly 20 gets hot, and, to turn off the piezoelectric fans when the circuit breaker 10 and/or said conductor assembly 20 cools down to an acceptable temperature.

Similarly, in an exemplary embodiment, the temperature management unit 110 is further structured to actuate a selected number of convection units 202 when a first current characteristic is detected in said conductor assembly 20. The temperature management unit 110 is further structured to actuate selected number of convection units 202 when a second current characteristic is detected in said conductor assembly 20. That is, colloquially, the temperature management unit 110 is structured to turn on piezoelectric fans 210, discussed below, when the conductor assembly 20 is carrying a relatively higher current, and, to turn off the piezoelectric fans when the conductor assembly 20 is carrying a relatively lower current. It is noted that, in this embodiment, the selected number of convection units 202 are actuated before the temperature rises significantly. That is, the increase in current precedes an increase in temperature.

In another exemplary embodiment, the temperature management unit 110 is further structured to maintain the same potential (voltage) with said circuit vacuum breaker 10. That is, the temperature management unit 110 has the same voltage as the vacuum circuit breaker 10 or load conductor 2. Thus, the temperature management unit 110 can work with the high voltage portion 14 separately without isolation between temperature management unit 110 and ground or low voltage end. In an exemplary embodiment, the power assembly 150 is structured to "harvest" energy from the vacuum circuit breaker 10 and/or said conductor assembly 20. That is, as used herein, "harvest" means to draw energy without direct electrical communication from the source and the power assembly 150. In an exemplary embodiment, the power assembly 150 includes a current transformer 152 and a number of bus members 154. The current transformer 152 is disposed about, i.e., encircling, either the line conductor 1, the load conductor 2, the first primary conductor 24, or the second primary conductor 34. As is known, the current transformer 152 harvests energy from one or more conductor assembly 20 elements selected from the group consisting of the line conductor 1, the load conductor 2, the first primary conductor 24, or the second primary conductor 34. The current transformer 152 harvests energy without being directly coupled, and in electrical communication, with the conductor 1, 2, 24, 34. Further, in this configuration, the current transformer 152, i.e., the power assembly 150, generates a "minimal current." As used herein, a "minimal current" means between about 10 and 30 amps.

In an exemplary embodiment, the number of heat exchanging elements 170 includes a heat sink 172. As used herein, a "heat sink" is a construct structured to absorb heat from one element and to dissipate the absorbed heat into a fluid medium such as, but not limited to air. A "finned heat sink" is a heat sink that includes "fins." As used herein, a "fin" is a generally thin member having a large surface area relative to the volume. Further, a "fin" may include surface features, such as, but not limited to, openings or grooves. Also, a "fin" may include elements having a curved cross-section. As used herein, a "planar fin" is a "fin" that is generally planar. A "planar fin" may also include surface features such as, but not limited to, openings, grooves, or an arcuate surface. For example, a corrugated sheet has grooves and peaks but is, overall, a planar member. Similarly, the outermost fins 178 (discussed below) have an arcuate surface but are still, as used herein, "planar fins." In an exemplary embodiment, as shown, each fin 178 is a planar fin 179. Further, as used herein, in a construct with a plurality of "fins," the "fins" are spaced. That is, a space between the fins is inherent in any construct including "fins."

In one exemplary embodiment, the heat sink 172 is a finned heat sink 174 that is thermally coupled to the conductor assembly 20. As used herein, "thermally coupled" means coupled in a manner that allows heat to be transferred between the elements or assemblies that are "thermally coupled." A finned heat sink 174 includes a base member 176 and a number of fins 178 extending therefrom. In an exemplary embodiment, there is a heat sink 172 thermally coupled to a number of the primary conductors 24, 34. As shown in FIG. 1, a first heat sink 174A is thermally coupled to the first primary conductor 24 and a second heat sink 174B is thermally coupled to the second primary conductor 34. Further, stated alternately, a number of the heat exchanging elements 170 include a number of fins 178. In an exemplary embodiment, the fins 178 are planar fins 179.

In another embodiment, the heat exchanging elements 170 includes a finned portion 180, 182 of a number of primary conductors 24, 34 (hereinafter "primary conductor finned portion"). That is, in this embodiment, one, or both, of the primary conductors 24, 34 define a number of fins 178. In an exemplary embodiment, the primary conductors 24, 34 include a number of passages 184 extending generally vertically through the primary conductors 24, 34. Further, in an exemplary embodiment, the primary conductor passages 184 are elongated slots 186 that define generally planar fins 188. As noted above, the outermost planar fins 188 in this embodiment include curved surfaces but are still, as used herein, "planar fins" 188.

In another embodiment, the heat exchanging elements 170 include both heat sink(s) 172 and finned portion(s) 180, 182 of a number of primary conductors 24, 34.

In an exemplary embodiment, the heat dissipating assembly 200 includes a number of convection units 202. As used herein, a "convection unit" is a construct, such as, but not limited to a fan, that is structured to move a fluid over a heated element such as, but not limited to, a heat sink 172 or an element that generates heat such as, but not limited to, a primary conductor 24, 34. In an exemplary embodiment, the number of convection units 202 includes a number of piezoelectric fans 210. As used herein, a "piezoelectric fan" 210 includes a piezoelectric unit 212 and an elongated planar member 214. Further, as used herein, a "piezoelectric unit" 212 is a construct that produces a mechanical motion, such as but not limited to vibration, via a piezoelectric effect. The planar member 214 includes a proximal end (not numbered) that is coupled, directly coupled, or fixed to an associated piezoelectric unit 212. The planar member 214 distal end (not numbered), i.e., the end opposite the proximal end is free to flex. Thus, a piezoelectric unit 212 creates a vibration that is transferred to the planar member 214 causing the distal end of the planar member 214 to flex rapidly. This, in turn, creates a directed fluid flow.

In an exemplary embodiment, each convection unit 202 is disposed immediately adjacent a number of the heat exchanging elements 170. As used herein "immediately adjacent," when used in reference to a convection unit 202 means that the element "immediately adjacent" thereto is in the directed fluid flow path. Thus, as shown, in one embodiment, each piezoelectric fan 210 is disposed immediately adjacent a finned heat sink 174 or a primary conductor finned portion 180, 182. Further, each piezoelectric fan 210 is substantially disposed within the space between the fins 178 of the finned heat sink 174 and/or the primary conductor finned portion 180, 182. As used herein, a piezoelectric fan 210 is "substantially disposed" within the space between the fins 178 when the majority of the planar member 214 is disposed between the fins 178. Further, in an exemplary embodiment, each piezoelectric fan 210 is coupled, directly coupled, or fixed to a heat exchanging element 170.

Further, in an exemplary embodiment, each piezoelectric fan 210 is powered by the power assembly 150. That is, a number of piezoelectric fans 210, collectively, is powered by a minimal current. Thus, as used herein, each of the number of convection units 202 is a "minimal current unit." That is, a construct that is powered by a "minimal current" is a "minimal current unit," as used herein. Further, each piezoelectric fan 210 is structured to be actuated by the temperature management unit 110.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A cooling system for a circuit breaker, said circuit breaker including a conductor assembly, said cooling system comprising:

a temperature management unit structured to detect the temperature at one of said circuit breaker or said conductor assembly;

a power assembly structured to harvest energy from said circuit breaker;

a heat dissipating assembly including a number of convection units;

a number of heat exchanging elements thermally coupled to said conductor assembly; and each said convection unit disposed immediately adjacent the number of said heat exchanging elements.

2. The cooling system of claim 1 wherein:

said temperature management unit is structured to detect the temperature at both said circuit breaker and said conductor assembly; and said temperature management unit is structured to actuate a selected number of convection units when a first temperature is detected at either said circuit breaker or said conductor assembly.

3. The cooling system of claim 2 wherein:

said temperature management unit includes a current sensor;

said current sensor structured to detect first characteristics in said conductor assembly; and said temperature management unit is structured to actuate selected number of convection units when a first characteristic in said conductor assembly is detected.

4. The cooling system of claim 2 wherein said temperature management unit and said number of convection units maintain the same potential with said circuit breaker.

5. The cooling system of claim 2 wherein said power assembly includes a current transformer.

6. The cooling system of claim 2 wherein said number of convection units includes a number of piezoelectric fans.

7. The cooling system of claim 2 wherein:

said number of heat exchanging elements include a number of fins;

said number of convection units includes a number of piezoelectric fans; and the number of said piezoelectric fans are substantially disposed within the space between said fins.

8. The cooling system of claim 7 wherein said conductor assembly includes a number of primary conductors and wherein:

said number of heat exchanging element includes a heat sink; and said heat sink thermally coupled to the number of said primary conductors.

9. The cooling system of claim 7 wherein said piezoelectric fans are directly coupled to the number of said heat exchanging elements.

10. The cooling system of claim 2 wherein each of said number of convection units is a minimal current unit.

11. A circuit breaker comprising:

a conductor assembly;

a cooling system including a temperature management unit, a power assembly, a number of heat exchanging elements, and a heat dissipating assembly;

said conductor assembly thermally coupled to a number of said heat exchanging elements;

said temperature management unit structured to detect the temperature at one of said circuit breaker or said conductor assembly;

said power assembly structured to harvest energy from said circuit breaker; and said heat dissipating assembly including a number of convection units, each said convection unit disposed immediately adjacent the number of said heat exchanging elements.

12. The circuit breaker of claim 11 wherein:

said temperature management unit is structured to detect the temperature at both said circuit breaker and said conductor assembly; and said temperature management unit is structured to actuate selected number of convection units when a first temperature is detected at either said circuit breaker or said conductor assembly.

13. The circuit breaker of claim 12 wherein:

said temperature management unit includes a current sensor;

said current sensor structured to detect first characteristics in said conductor assembly; and said temperature management unit is structured to actuate selected number of convection units when a first characteristic in said conductor assembly is detected.

14. The circuit breaker of claim 12 wherein said temperature management unit and said number of convection units maintain the same potential with said circuit breaker.

15. The circuit breaker of claim 12 wherein said power assembly includes a current transformer.

16. The circuit breaker of claim 12 wherein said number of convection units includes a number of piezoelectric fans.

17. The circuit breaker of claim 12 wherein:

said conductor assembly includes a number of primary conductors;

said number of heat exchanging elements includes a number of fins;

wherein said primary conductors define said number of fins;

said number of said convection units includes a number of piezoelectric fans; and the number of said piezoelectric fans are substantially disposed within the space between said fins.

18. The circuit breaker of claim 17 wherein:

said conductor assembly includes a number of primary conductors;

said number of heat exchanging elements includes a heat sink; and said heat sink thermally coupled to the number of said primary conductors.

19. The circuit breaker of claim 17 wherein:

said conductor assembly includes a number of primary conductors; and the number of primary conductor defines the number of said heat exchanging elements.

20. The circuit breaker of claim 12 wherein each of said number of convection units is a minimal current unit.

* * * * *